US008562308B1

(12) United States Patent
Krug et al.

(10) Patent No.: US 8,562,308 B1
(45) Date of Patent: Oct. 22, 2013

(54) REGENERATIVE HYDRAULIC LIFT SYSTEM

(75) Inventors: David A. Krug, Fairview, OR (US); Stanley D. Nelsen, Brush Prairie, WA (US); J. Dennis Allison, Camas, WA (US)

(73) Assignee: Rodmax Oil & Gas, Inc., Lindon, UT (US)

( * ) Notice: Subject to any disclaimer, the term of this patent is extended or adjusted under 35 U.S.C. 154(b) by 0 days.

(21) Appl. No.: 13/317,139

(22) Filed: Oct. 11, 2011

Related U.S. Application Data

(60) Division of application No. 11/548,256, filed on Oct. 10, 2006, now Pat. No. 8,083,499, which is a continuation-in-part of application No. 11/001,679, filed on Nov. 30, 2004, now abandoned.

(60) Provisional application No. 60/526,350, filed on Dec. 1, 2003.

(51) Int. Cl.
*F04B 41/06* (2006.01)
*F04B 23/10* (2006.01)
*F04B 17/03* (2006.01)

(52) U.S. Cl.
USPC ..... 417/237; 417/46; 417/390; 417/904

(58) Field of Classification Search
USPC ..... 417/46, 390, 555.2, 904, 237; 92/165 PR
See application file for complete search history.

(56) References Cited

U.S. PATENT DOCUMENTS

| | | | |
|---|---|---|---|
| 162,406 | A | 4/1875 | Nickerson |
| 226,948 | A | 4/1880 | Yates |
| 245,101 | A | 8/1881 | Thayer |
| 562,999 | A | 6/1896 | Yates |
| 593,826 | A | 11/1897 | Yates |
| 635,630 | A | 10/1899 | Yates |
| 658,276 | A | 9/1900 | McCariston |
| 685,641 | A | 10/1901 | Reid |
| 813,913 | A | 2/1906 | Reid |
| 851,104 | A | 4/1907 | Reid |
| 1,242,548 | A | 10/1917 | Harris |
| 1,686,925 | A | 10/1928 | Reid |
| 1,716,088 | A | 6/1929 | Reid |
| 1,851,908 | A | 3/1932 | Hoover |
| 1,900,675 | A | 3/1933 | Trout |
| 2,008,980 | A | 7/1935 | Gruber |
| 2,072,595 | A | 3/1937 | Hutchison |
| 2,093,352 | A | 9/1937 | Duda |
| 2,107,234 | A | 2/1938 | Chambers |
| 2,221,292 | A | 11/1940 | Trout et al. |
| 2,276,358 | A | 3/1942 | Vickers |

(Continued)

*Primary Examiner* — Charles Freay
*Assistant Examiner* — Philip Stimpert
(74) *Attorney, Agent, or Firm* — J. David Nelson

(57) ABSTRACT

A hydraulic cylinder assembly for a fluid pump including a cylinder, a bearing attached to an approximate first end of the cylinder, a rod slideably mounted within the bearing, and a piston located about an end of the rod in the cylinder opposite the bearing. A central axis of the rod is offset from, and parallel to, a centerline of the cylinder to impede a rotation of the piston about the rod. The hydraulic cylinder assembly further including a hydraulic pump fluidly connected to the cylinder, the pump configured to provide a hydraulic pressure to the cylinder during an up-stroke of the piston and rod and the pump further configured to generate electricity on the down-stroke of the piston and rod.

7 Claims, 5 Drawing Sheets

(56) References Cited

U.S. PATENT DOCUMENTS

| | | | | |
|---|---|---|---|---|
| 2,299,692 | A | 10/1942 | Goehring | |
| 2,456,456 | A | 12/1948 | Smith | |
| 2,704,221 | A | 3/1955 | Gwinn, Jr | |
| 2,728,193 | A | 12/1955 | Bacchi | |
| 3,134,232 | A | 5/1964 | Barosko | |
| 3,282,566 | A | 11/1966 | Clarke | |
| 3,343,409 | A | 9/1967 | Gibbs | |
| 3,483,828 | A | 12/1969 | Bender | |
| 3,610,799 | A | 10/1971 | Hubby | |
| 3,619,360 | A | 11/1971 | Persik | |
| 3,782,117 | A | 1/1974 | James | |
| 3,792,836 | A | 2/1974 | Bender | |
| 3,823,651 | A | 7/1974 | Ogilvie | |
| 3,880,054 | A | 4/1975 | Domyan | |
| 3,930,752 | A | 1/1976 | Douglas | |
| 3,951,209 | A | 4/1976 | Gibbs | |
| 3,965,736 | A | 6/1976 | Welton et al. | |
| 4,034,808 | A | 7/1977 | Patterson | |
| 4,114,375 | A | 9/1978 | Saruwatari | |
| 4,118,148 | A | 10/1978 | Allen | |
| 4,125,163 | A | 11/1978 | Fitzpatrick | |
| 4,143,546 | A | 3/1979 | Wiener | |
| 4,176,520 | A | 12/1979 | Horton | |
| 4,185,539 | A | 1/1980 | Stratienko | |
| 4,220,440 | A | 9/1980 | Taylor et al. | |
| 4,284,943 | A | 8/1981 | Rowe | |
| 4,286,803 | A | 9/1981 | Schulz | |
| 4,286,925 | A | 9/1981 | Standish | |
| 4,305,461 | A | 12/1981 | Meyer | |
| 4,400,141 | A * | 8/1983 | Lee et al. | 417/360 |
| 4,406,597 | A | 9/1983 | Stanton | |
| 4,490,094 | A | 12/1984 | Gibbs | |
| 4,496,285 | A | 1/1985 | Albert et al. | |
| 4,509,901 | A | 4/1985 | McTamaney et al. | |
| 4,548,296 | A | 10/1985 | Hasegawa | |
| 4,631,918 | A | 12/1986 | Rosman | |
| 4,637,459 | A | 1/1987 | Roussel | |
| 4,646,518 | A | 3/1987 | Hochsattel | |
| 4,651,582 | A | 3/1987 | Bender | |
| 4,707,993 | A | 11/1987 | Kime | |
| 4,715,180 | A | 12/1987 | Rosman | |
| 4,723,107 | A * | 2/1988 | Schmid | 322/35 |
| 4,724,672 | A | 2/1988 | Olmsted | |
| 4,801,126 | A | 1/1989 | Rosman | |
| 4,810,159 | A | 3/1989 | Stegmuller | |
| 4,848,085 | A | 7/1989 | Rosman | |
| 4,896,584 | A * | 1/1990 | Stoll et al. | 92/5 R |
| 5,018,350 | A | 5/1991 | Bender | |
| 5,167,490 | A | 12/1992 | McKee et al. | |
| 5,184,877 | A | 2/1993 | Miyakawa | |
| 5,237,916 | A | 8/1993 | Malashenko | 100/269.14 |
| 5,252,031 | A | 10/1993 | Gibbs | |
| 5,309,992 | A | 5/1994 | Watson | |
| 5,310,140 | A | 5/1994 | Veaux et al. | |
| 5,318,409 | A | 6/1994 | London et al. | |
| 5,372,482 | A | 12/1994 | London et al. | |
| 5,441,389 | A | 8/1995 | Wolcott et al. | |
| 5,481,873 | A | 1/1996 | Saruwatari et al. | |
| 5,486,106 | A | 1/1996 | Hehl | |
| 5,589,633 | A | 12/1996 | McCoy et al. | |
| 5,750,952 | A * | 5/1998 | Johnson | 219/89 |
| 5,819,849 | A | 10/1998 | Booth | |
| 5,827,051 | A | 10/1998 | Smith | |
| 5,839,348 | A * | 11/1998 | Iida et al. | 92/117 A |
| 5,941,305 | A | 8/1999 | Thrasher et al. | |
| 6,200,416 | B1 | 3/2001 | Brotto et al. | |
| 6,315,523 | B1 | 11/2001 | Mills | |
| 6,316,523 | B1 | 11/2001 | Hyon et al. | |
| 6,343,656 | B1 | 2/2002 | Vazquez et al. | |
| 6,379,119 | B1 | 4/2002 | Truninger | |
| 6,409,476 | B2 | 6/2002 | Mills | |
| 6,414,455 | B1 | 7/2002 | Watson | |
| 6,499,295 | B1 | 12/2002 | Dantlgraber | |
| 6,592,334 | B1 | 7/2003 | Butler | |
| 6,749,017 | B1 | 6/2004 | Lu et al. | |
| 7,117,120 | B2 | 10/2006 | Beck et al. | |
| 7,143,016 | B1 | 11/2006 | Discenzo et al. | |
| 7,168,924 | B2 | 1/2007 | Beck et al. | |
| 7,212,923 | B2 | 5/2007 | Gibbs et al. | |
| 7,218,997 | B2 | 5/2007 | Bassett | |
| 7,314,349 | B2 | 1/2008 | Mills | |
| 7,316,542 | B2 | 1/2008 | Mills | |
| 7,500,390 | B2 | 3/2009 | Mills | |
| 7,562,701 | B2 | 7/2009 | Lacusta et al. | |
| 8,087,904 | B2 * | 1/2012 | Best | 417/271 |
| 2003/0010491 | A1 | 1/2003 | Collette | |
| 2004/0062657 | A1 | 4/2004 | Beck et al. | |
| 2004/0091363 | A1 | 5/2004 | Butler | |
| 2005/0238495 | A1 | 10/2005 | Mills | |
| 2005/0238496 | A1 * | 10/2005 | Mills | 417/42 |
| 2005/0281680 | A1 | 12/2005 | Schulz | |
| 2005/0283277 | A1 | 12/2005 | Schulz | |
| 2006/0024171 | A1 | 2/2006 | Smith et al. | |
| 2006/0024177 | A1 | 2/2006 | Robison et al. | |
| 2006/0052903 | A1 | 3/2006 | Bassett | |
| 2006/0251525 | A1 | 11/2006 | Beck et al. | |
| 2007/0020110 | A1 | 1/2007 | Mills | |
| 2007/0110598 | A1 | 5/2007 | Jacobs et al. | |
| 2007/0148007 | A1 | 6/2007 | Garlow | |
| 2008/0067116 | A1 | 3/2008 | Anderson et al. | |

* cited by examiner

REGENERATIVE HYDRAULIC LIFT SYSTEM

This application claims priority to and is a Divisional Application of U.S. patent application Ser. No. 11/548,256 filed on Oct. 10, 2006 now U.S. Pat. No. 8,083,499, which was a Continuation In Part (CIP) of U.S. patent application Ser. No. 11/001,679 filed on Nov. 30, 2004 now abandoned which claims priority to Provisional Application 60/526,350 filed on Dec. 1, 2003. The disclosures of the Ser. Nos. 11/548,256, 11/001,679 and 60/526,350 applications are herein incorporated by reference. Claims 8, 10, 11 and 12 of application Ser. No. 11/548,256, which claims were elected pursuant to a restriction requirement, have been allowed. The claims presented for this divisional application, namely claims 1-7 and 13-20, were non-elected without traverse, and are original claims of application Ser. No. 11/548,256. These claims were initially withdrawn and subsequently cancelled at the time of allowance of claims 8, 10, 11 and 12. No amendments have been made to any of the claim 1-7 or 13-20 as originally presented. The specification presented with this divisional application is identical to the specification of application Ser. No. 11/548,256, except that claims 8, 10, 11 and 12 are presented in the form allowed and claim 9 was canceled during the prosecution of application Ser. No. 11/548,256. The drawings are identical to the drawings originally presented for application Ser. No. 11/548,256, except for FIG. 5, which was corrected during the prosecution of application Ser. No. 11/548,256. No new matter has been added.

BACKGROUND OF THE INVENTION

Disclosed herein are a system, apparatus and method for recapturing energy in lift systems.

Many lift systems produce a substantial amount of non-useful energy. These lift systems can be of various configurations such as of a reciprocating type. More particularly, in the case of certain reciprocating lift systems, these reciprocating loads/actions are performed by reciprocating rod-type lift systems. When these lift system produce a substantial amount of non-useful energy it can be dissipated, for example, in the form of heat due to a great extent to the pressure differential of certain fluid regulating devices. This lifting equipment typically has, for instance, elements that move up and/or move down, or which speed up and/or slowdown.

For example, a reciprocating rod lift system can be provided for artificially lifting of down well fluid production systems from a subterranean reservoir or stratus layer(s) for purposes of raising or lowering same to desired positions, and for speeding up or slowing down same. In these systems, much of the total energy used to lift fluid and gas from the well is directed toward operating a sucker rod string and down hole pump.

There is some useful, non-recoverable energy expended in the pumping process, consisting of friction from pivot bearings, mechanical non-continuously lubricated bearings, cables/sheaves, gear box friction, and gear contact friction. In some conventional systems, high pressure nitrogen gas leakage along with heat of compression of said gas results in loss of non-recoverable energy required to counterbalance the weight of the down hole component while lowering the sucker rod string into the well. Still other energy loss occurs for certain non-recoverable inefficiencies such as friction or windage.

Some conventional lift systems provide for a means of recapturing energy by means of storing energy in a physical counterweight or flywheel during a downward stroke of the down hole component. A large mechanical crank mounted counterbalance is used to counter the effect of the down hole component weight and provide resistance to movement as the down hole component is lowered into the well.

Other systems store energy by compressing a gas, such as nitrogen, during the downward stroke. These systems similarly oppose movement of the down hole component and store the energy while lowering the load. A minimum and maximum pressure level is fluctuated based upon an initial precharge ambient temperature and a rate of pressure change.

In yet other conventional lift systems, the fluid flow is restricted over a metering or throttling valve, thereby wasting all the energy contained in the elevation by merely heating the hydraulic fluid. Heat from these throttling devices must then be dispelled employing coolers that use even more energy.

The inherent inefficiencies of these and other conventional systems, in addition to the other non-recoverable energy expended during operation of down well fluid production systems, increase the cost of materials extraction.

The present invention addresses these and other problems associated with the prior art.

SUMMARY OF THE INVENTION

A method is herein disclosed for pumping a subterranean fluid to the surface of the earth. The method includes increasing a hydraulic pressure at a first control rate during a pumping operation and decreasing the hydraulic pressure at a second control rate during a lowering operation. The method further includes controlling an amount of down hole fluid being pumped during the pumping operation by metering the first control rate and controlling a lowering speed of a down hole pump by metering the second control rate. The first and second control rates may be metered according to a hydraulic pressure being provided by a pump, wherein electricity is generated during the lowering operation.

A system for pumping the fluid may include a hydraulic pump, a down hole pump, and a rod and cylinder assembly. The rod is configured to reciprocate up and down with respect to the cylinder according to a hydraulic pressure supplied by the pump to control an operation of the down hole pump.

A hydraulic cylinder assembly for a fluid pump may include a cylinder, a bearing attached to an approximate first end of the cylinder, a rod slideably mounted within the bearing, and a piston located about an end of the rod in the cylinder opposite the bearing. A central axis of the rod is offset from, and parallel to, a centerline of the cylinder to impede a rotation of the piston about the rod.

The foregoing and other objects, features and advantages of the invention will become more readily apparent from the following detailed description of a preferred embodiment of the invention which proceeds with reference to the accompanying drawings.

DESCRIPTION OF EXAMPLE EMBODIMENTS

A lift system may be used for pumping down hole fluids to the surface to obtain natural gas or petroleum that is contained therein. Similarly a lift system may be used to raise other fluid from a down hole well to above ground. A reciprocating rod lift system is one such system.

In one application, a lift system is used to dewater coal bed methane gas wells. The methane gas found in coal beds tends to adhere to a local surface while under pressure. When the coal beds are submerged in water, the hydraulic pressure causes the methane gas to adhere to the coal itself according to the principle of adsorption. When the lift system removes and raises the water, the hydraulic pressure acting on the methane gas is temporarily decreased, which allows the methane gas to desorb off the coal and flow through coal seams to the surface. The methane gas is then removed from the raised water by conventional means.

As the water is removed from the coal bed, the existing ground water will tend to refill the coal bed back to at or near its previous level over time. When the water reaches its equilibrium level due to the inflow of the ground water, the hydraulic pressure tends to retain the existing methane gas as described above. However, if the lift system continues to remove the water at a rate that exceeds the ability of the ground water to refill the coal bed, then the hydraulic pressure will continue to decrease, causing more of the methane gas to desorb and flow to the surface.

If the lift system continues to remove water, at some point the coal bed may be effectively pumped dry, if at least temporarily. Operation of the lift system without sufficient amounts of down hole water may cause serious damage to the lift system and its components. In some conventional systems, the lift system operates for some set period of time, and then rests idle while the coal bed refills with water. The system will therefore cycle on and off to remove the water and then allow the water level to refill.

In one embodiment, the lift system monitors a hydraulic pressure associated with the removal of the down hole water so that it can control the rate at which the water is removed. By controlling the rate of water removal to avoid the down hole well from being pumped dry, the lift system can continuously operate without having to cycle between the on and off operating modes. As such, a smaller lift system may be used as compared to conventional pumps when removing an equivalent amount of methane gas over time. Smaller lift systems use less electricity to operate and have lower operating and up front purchasing costs.

Figure 1:
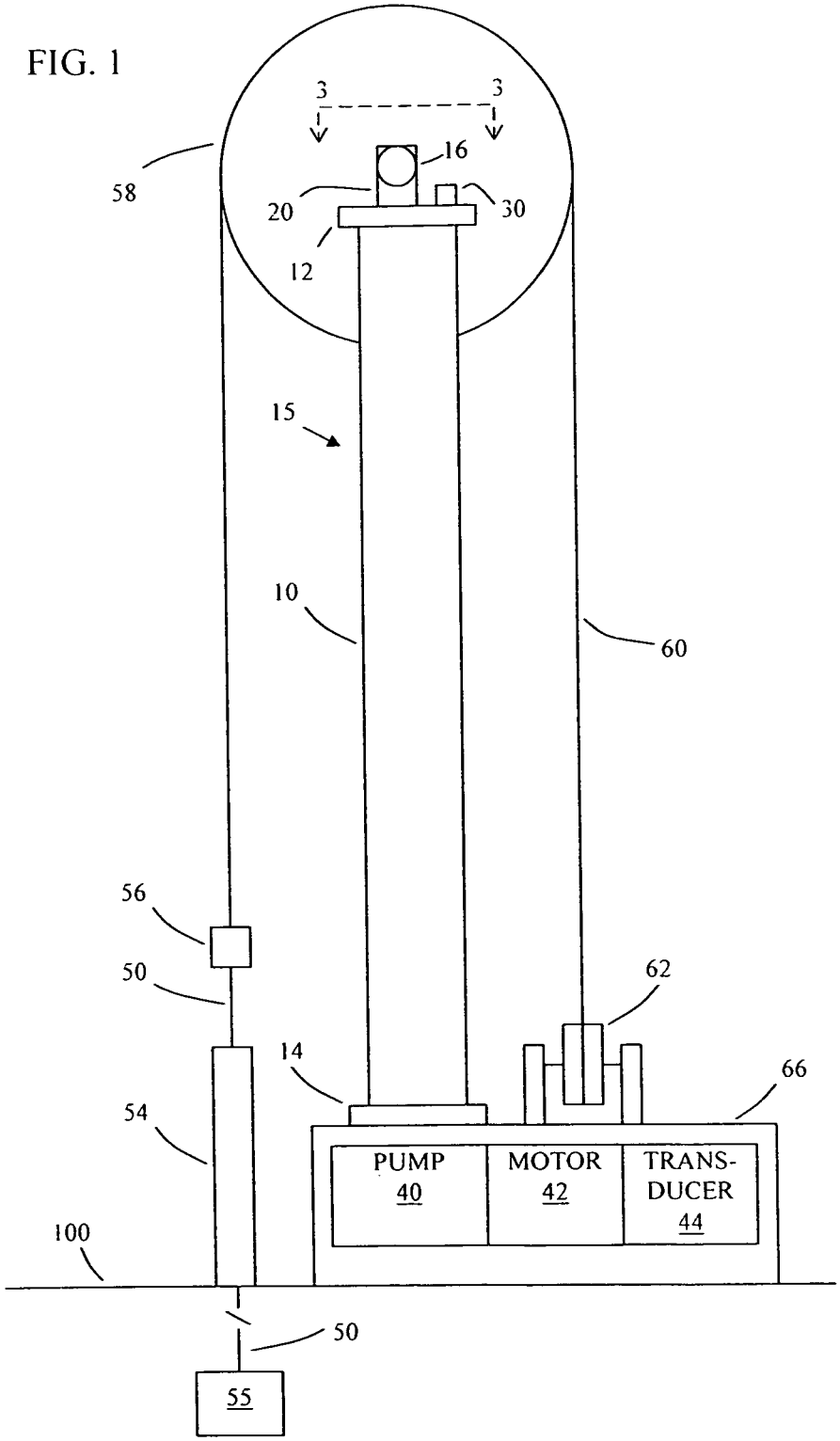
FIG. 1 illustrates an example hydraulic lift system including a linear actuator.

FIG. 1 illustrates an example hydraulic lift system including a linear actuator 15 that may be used to pump fluid from a down hole well. The lift system includes a hydraulic pump 40 and motor 42, a fluid pressure transducer 44, a conventional down hole pump 55 and the linear actuator 15. The linear actuator 15 includes a rod 20 and cylinder 10, and is shown mounted to a base unit 66 which is placed on the ground 100. The pump 40, motor 42, and transducer 44, represented as simple operational blocks, may be contained within the base unit 66.

A sheave 58, or wheel, is rotatably mounted about a pinion 16 connected to the rod 20 near a first end 12 of the cylinder 10. The sheave 58 may rotate in either a clockwise or counterclockwise direction of rotation about the pinion 16. In one embodiment, two or more sheaves, similar to sheave 58, may be rotatably mounted about the pinion 16 to provide for additional mechanical advantage, as is known in conventional pulley systems. A cable 60 is connected at one end to an equalizer sheave or idler pulley 62 which may be mounted to the base unit 66. The cable 60 engages an upper radial section of the sheave 58. A second end of the cable 60 is shown connected to a carrier bar 56, hanging suspended from the sheave 58. A sucker rod string or sucker rod 50 is connected to the carrier bar 56 and inserted into a well head 54. The well head 54 directs the sucker rod 50 down beneath the ground 100 into the down hole well, where the sucker rod 50 is further connected to the down hole pump 55.

The rod 20 is slideably mounted to the cylinder 10 in a radially offset position from a centerline of the cylinder 10, and configured to reciprocate up and down according to a hydraulic pressure supplied by the pump 40 to control an operation of the down hole pump 55. A sensor 30 is mounted within the cylinder 10 and spaced apart from the rod 20. An exposed portion of the sensor 30 is visible from the first end 12 of the cylinder, and includes electronics that are accessible for maintenance. The sensor 30 is configured to measure a rod position within the cylinder 10 which is transmitted as a sensor input. The pump 40 controls the hydraulic pressure within the cylinder 10 during both up and down reciprocating motions of the rod 20 to control a pumping rate of the down hole pump 55.

Figure 2:
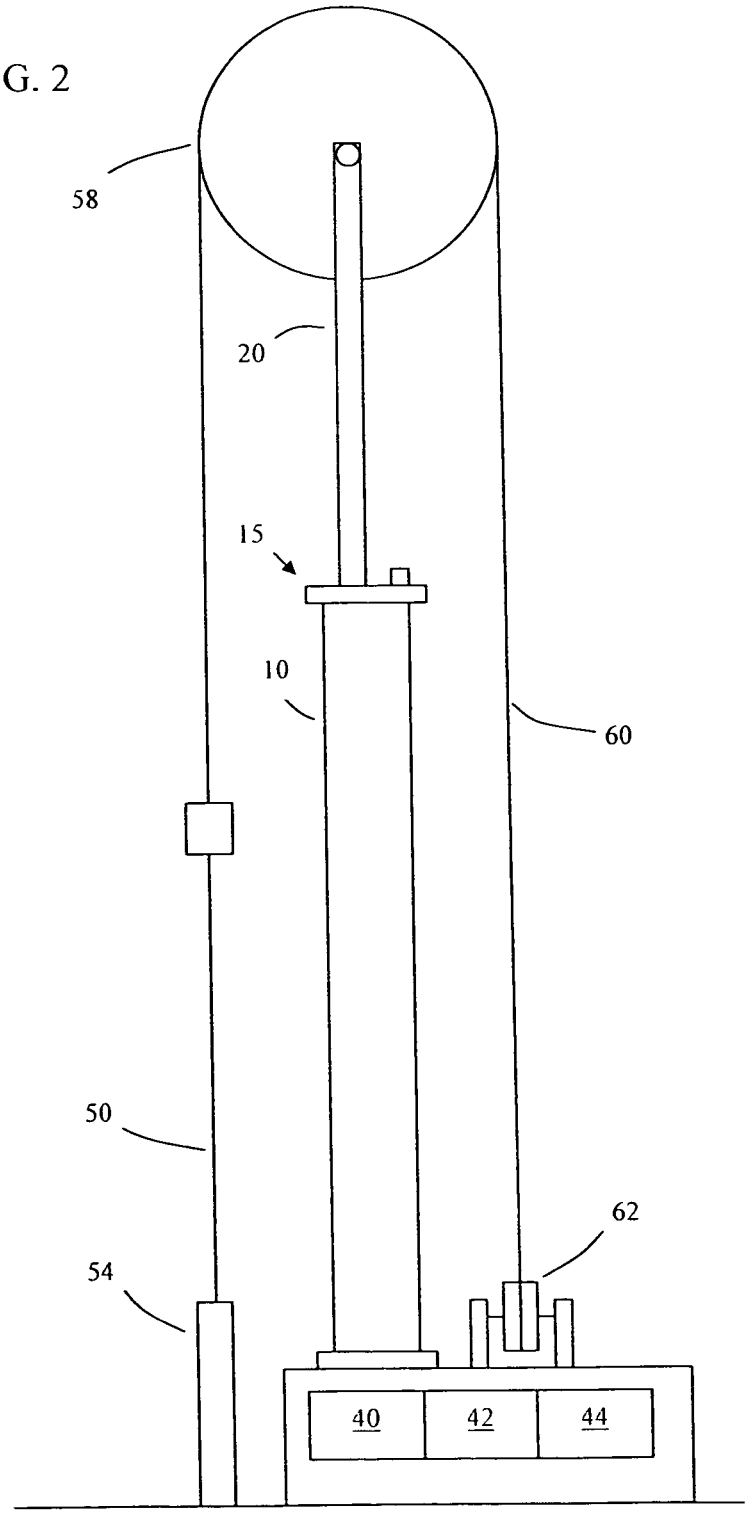
FIG. 2 illustrates the hydraulic lift system of FIG. 1 with the linear actuator in an extended position.

FIG. 2 illustrates the hydraulic lift system of FIG. 1 in an extended position. As the pump 40 increases the hydraulic pressure within the cylinder 10, a hydraulic force exerted on the rod 20 causes the rod 20 to raise to the extended position. Because one end of the cable 60 is connected to the idler pulley 62, as the rod 20 is raised, the sheave 58 rotates in a clockwise rotational direction due to a friction force with the cable 60. As the sheave 58 raises and rotates, it lifts the sucker rod 50 and the down hole pump 55 located beneath the well head 54 (FIG. 1). At the end of the upstroke of the rod 20, the pump 40 decreases the hydraulic pressure in the cylinder 10, allowing the rod 20, and down hole pump 55, to lower. As the down hole pump 55 is raised and lowered successively, water, or other fluid, located in the down hole well is pumped and raised to the surface.

Figure 3:
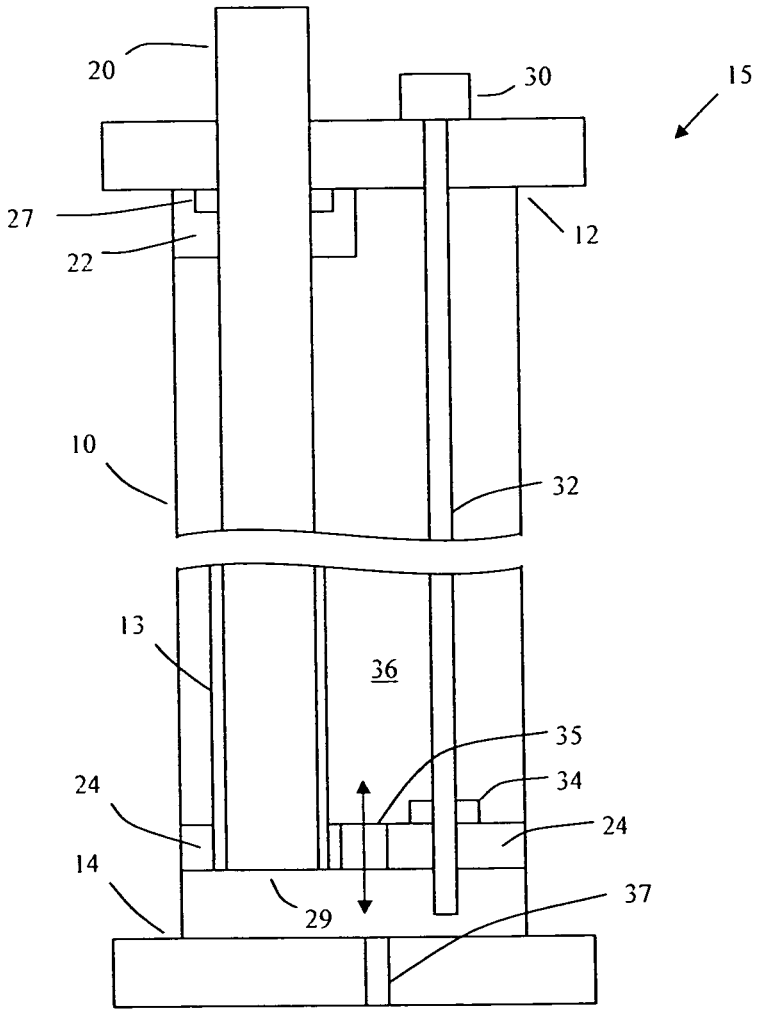
FIG. 3 illustrates a cross sectional view of an example linear actuator.

FIG. 3 illustrates a cross sectional view of an example linear actuator 15 shown with reference to the hydraulic lift system of FIG. 1 and identified as reference number 3-3. The rod 20 and cylinder 10 are shown in partial view, where the middle section of the assembly has been removed for convenience. A bearing 22 is shown attached to an approximate first end 12 of the cylinder 10, wherein the rod 20 is slideably mounted within the bearing 22. The bearing 22 may include a rod seal 27. The rod seal 27 may include one or more seals as well as a wiper mechanism to keep the rod seal 27 and hydraulic fluid clean. A piston 24 is located in the cylinder 10 about an end of the rod 20 opposite the bearing 22. The piston 24 extends through an inner diameter of the cylinder 10. The piston 24 includes a channel 35 which allows hydraulic fluid in cavity 36 to be released through the piston 24 in either an upwards or downwards direction as the rod 20 reciprocates within the cylinder 10. In one embodiment, channel 35 includes two through holes.

The lower end 29 of the rod 20 is shown supported within a stop tube 13, which may be mounted to the piston 24. The stop tube 13 provides additional support for the rod 20 particularly when the rod 20 is in the extended position, shown in FIG. 2. A length of the stop tube 13 may be approximately one half the length of the rod 20, such that the distance of the upstroke of the rod 20 would be nearly equal to the length of the stop tube 13.

The sensor 30 includes a sensor probe 32 attached to the first end 12 of the cylinder 10 and extending through the piston 24 towards a second end of the cylinder 14. Sensor probe 32 may include a magnetostrictive position monitoring transducer having a pressure tube assembly with a magnetostrictive strip, for example. The first end 12 of the cylinder 10 may be referred to as a rod end cap. The second end 14 of the cylinder 10 may be referred to as a mounting base or cap end. A proximity device 34 is attached to the piston 24, the sensor probe 32 also extending through the proximity device 34. The proximity device 34 may be a magnet or magnetic device that provides a relative position of the piston 24 with respect to the sensor probe 32. For example, the sensor 30 and sensor probe 32 may include a feedback transducer that measures a relative position of the piston 24 within the cylinder 10.

The hydraulic pump 40 is fluidly connected to the cylinder 10 by a hydraulic port 37. The pump 40 is configured to provide a hydraulic pressure to cavity 36 in the second end 14 of the cylinder 10. Hydraulic fluid in cavity 36 flows down through the channel 35 as the rod 20 is raised, and hydraulic fluid flows up through the channel 35 as the rod 20 is lowered. Because the hydraulic pressure in cavity 36 is approximately equalized on either side of the piston 24, the hydraulic force does not act directly against the piston 24. The hydraulic pressure in cavity 36 acts against the lower end 29 of rod 20, causing the rod 20 to raise or lower within the cylinder 10 as the pressure is modulated by the pump 40. The bearing 22 and sensor probe 32 do not move vertically up and down while the piston 24 and rod 20 reciprocate. By determining a position of the piston 24, the sensor 30 is also able to determine a position of the rod 20 within the cylinder 10.

The position of the bearing 22 is fixed with respect to the first end 12 or rod end cap of the cylinder 10, whereas the piston 24 is constrained and guided by the inner diameter of the cylinder 10 as the rod 20 and piston 24 reciprocate up and down. As the rod 20 is raised and lowered within the cylinder 10, its lateral or rotational movement is therefore constrained by the bearing 22 and the piston 24.

The linear actuator 15 of FIG. 3 may be incorporated into the hydraulic lift system of FIG. 1. The pump 40 and motor 42 of FIG. 1 may therefore be configured to pump a down hole fluid during an up-stroke of the piston 24 and rod 20. The pump 40 and motor 42 may be further configured to generate electricity on the down-stroke of the piston 24 and rod 20.

Figure 4:
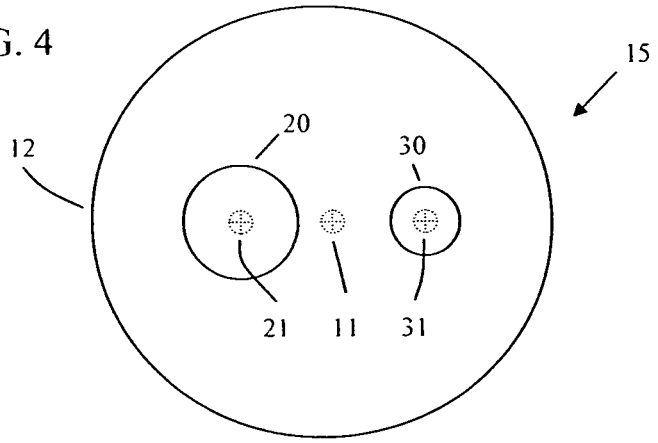
FIG. 4 illustrates a top view of the linear actuator illustrated in FIG. 1.

FIG. 4 illustrates a top view of the linear actuator 15 illustrated in FIG. 3, showing the first end 12 of the cylinder 10. The rod 20 includes a central axis 21 that is offset from, and parallel to, a centerline 11 of the cylinder 10. A central axis 31 of the sensor probe 30 is shown offset from the central axis 21 of the rod 20. During the reciprocating motion of the rod 20 within the cylinder 10, the hydraulic force of the pressurized fluid in cavity 36 tends to impart a rotational force to the piston 24 about the rod 20.

By offsetting the rod 20 from the centerline 11 of the cylinder 10, and furthermore slideably mounting the rod 20 through the bearing 22, the rotational force acting on the piston 24 about the rod 20 is impeded. The bearing 22 maintains the rod 20 in a substantially fixed vertical orientation within the cylinder 10, and acts through the rod 20 to maintain a similar orientation of the piston 24. By impeding this rotation of the piston 24, the sensor 30 and sensor probe 32 are protected from damage that might otherwise occur due to the rotational force acting on the piston 24.

Figure 5:
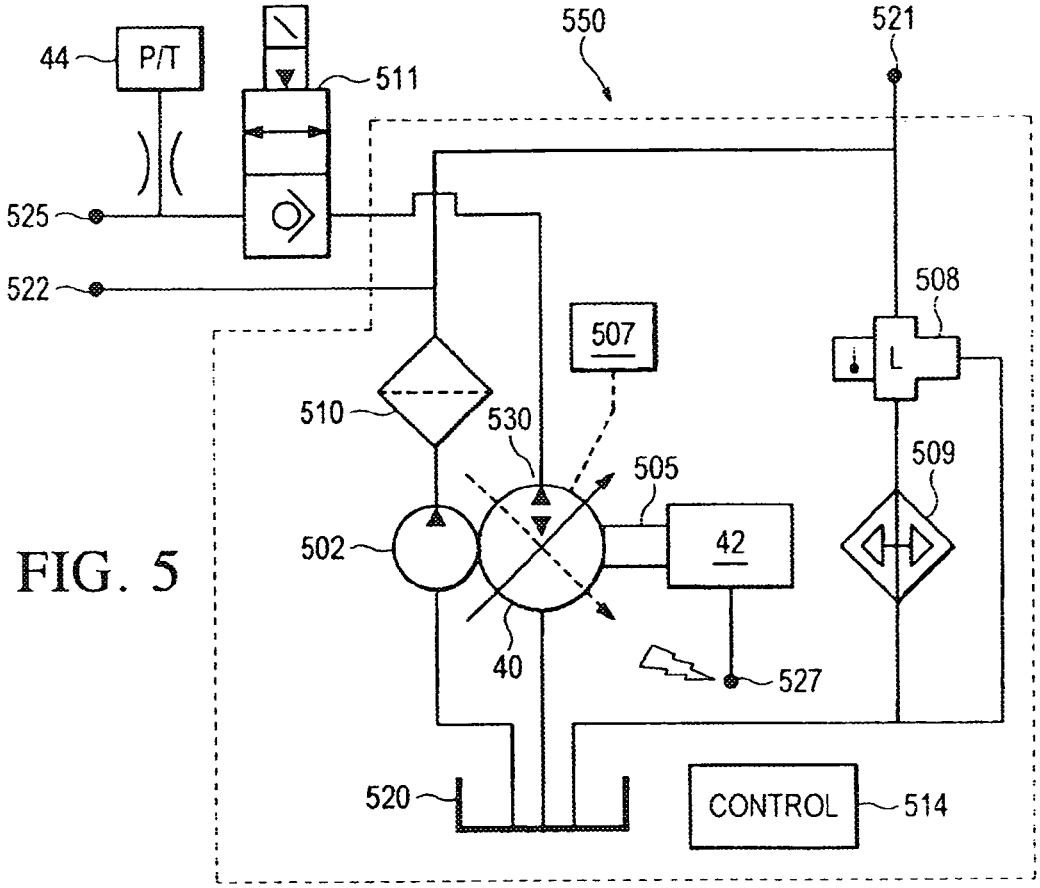
FIG. 5 illustrates an example hydraulic system schematic of a lift system.

FIG. 5 illustrates an example hydraulic schematic of a regenerative hydraulic lift system. The hydraulic schematic in FIG. 5 includes an electronic closed loop control system. A closed loop controller 514 is included in a hydraulic transformer shown as functional block 550. The hydraulic transformer 550 may include the controller 514, the motor 42 and the pump 40, as well as other components shown in FIG. 5.

A control valve 507 may be remotely controlled by the controller 514 to increase pressure in the system according to a predetermined rate of change and the maximum amplitude in a closed loop (PID) control algorithm. Controller 514 is able to provide a command signal to control valve 507 to increase a hydraulic pressure at a predetermined rate of change and amplitude. Control valve 507 is able to command the pump 40 to produce a flow rate to the linear actuator 15 of FIG. 3. The pump 40 may therefore be remotely controlled as a variable axial piston pump. The output signal of the control valve 507 may be modified by the controller 514 based upon a previous cycle of linear actuator 15. If the pressure transducer 44 measures a pressure which is not consistent with the previous cycle, the controller 514 may suspend repressurization of the hydraulic system for a period of time, or dwell time, in order for the cycle to correct itself. After the dwell time has elapsed, control valve 507 may again be commanded by the controller 514 to increase the pressure signal to the pump 40.

When the sensor 30 of FIGS. 1-3 determines that the piston 24 is approaching a predetermined upper position with respect to the first end 12 of the cylinder 10, the controller 514 commands the control valve 507 to decrease the pressure signal to the pump 40. Discharging the fluid rate of the pump 40 in a controlled manner also results in less system shock. The control valve 507 then further decreases the pressure signal to the pump 40, which allows the rod 20 to lower.

Hydraulic fluid lines 521 and 522 may be connected to the rod seal 27, providing both a seal flush supply and a seal flush drain, respectively, for the hydraulic fluid. The hydraulic system of FIG. 3 may also include a recirculation pump 502 to filter and cool the hydraulic fluid, a thermostatic bypass valve 508 and an air to oil heat exchanger 509.

Fluid line 525 is connected to hydraulic port 37 of FIG. 3. When a fluid pressure in fluid line 525 is equal to a fluid pressure in the cavity 36 of FIG. 3, the rod 20 is stationary. When the fluid pressure in the fluid line 525 is higher than the pressure in the cavity 36, then the rod 20 is raised or elevated. When the fluid pressure in the fluid line 525 is lower than the pressure in the cavity 36, then the rod 20 is lowered. Alternately increasing and decreasing the pressure in fluid line 525 therefore results in the reciprocating motion of the rod 20 within the cylinder 10. Fluid line 525 may include a fluid connection between the pressure transducer 44 and the hydraulic port 37. The pressure transducer 44 may be included in a manifold (not shown) which is mounted directly to the rod base at the second end 14 of the cylinder 10 in FIG. 3. The manifold may include both the transducer 44 and a solenoid valve 511 or emergency lock valve of FIG. 5.

The pressures in the fluid line 525 are monitored by the pressure transducer 44 and controlled by the pump 40. The pressure transducer 44 converts fluid pressure into a feedback signal that monitors load amounts. The pump 40 may be included in, or referred to as a hydraulic transformer. The pump 40 controls the rate at which hydraulic fluid is pumped from a port 530 when a load, including the sucker rod 50 of FIG. 1, is being lifted. The pump 40 further is able to control the rate at which the hydraulic fluid is reclaimed during a downstroke of the rod 20. The pump 40 is connected to the motor 42 by a shaft coupling set 505. As the pump 40 consumes the pressurized hydraulic fluid through port 530 during the downstroke, it produces an increase of shaft torque to motor 42 which causes it to rotate above a synchronous speed that was used to drive the pump 40 when the load was being lifted. The elevated rotational speed of the motor 42 generates electrical energy at a rate that is determined by the efficiencies of the lift system as well as the amount of load being supported by the lift system. The generated electrical energy may be output on electrical line 527.

Port 530 may therefore serve as both a supply port and an inlet port to pump 40. The port 530 is configured to function as an inlet port of the pump 40 during a down stroke of the rod 20, and as a supply port during an upstroke of the rod 20. This allows the system to alternatively function as a generator of energy and then as a consumer of energy during an upstroke and downstroke of the rod 20.

When the linear actuator 15 is lowering the sucker rod 50 and down hole pump 55, as shown in FIG. 1, the hydraulic fluid is returned from the cavity 36 to the hydraulic reservoir 520. Pressured hydraulic fluid trapped underneath the rod 20 is swallowed by the pump 40 as described above. When the linear actuator 15 is raising sucker rod 50 and the down hole pump 55, as shown in FIG. 2, the hydraulic fluid from a hydraulic reservoir 520 is pumped into the cavity 36 when the rod 20 is being raised. Energy is required to pump the hydraulic fluid into the cavity 36. The closed loop control system described in FIG. 5 provides for a method of controlling the speed and force of the lift system according to changing down hole conditions and work load. By controlling the flow rate and pressure of the hydraulic fluid, the pump 40 is able to control both the raising and lowering of the rod 20 without the use of a throttle. The hydraulic system as described produces significantly less heat compared to conventional systems which operate with throttles in which the heat and potential energy in the lift system are wasted.

Figure 6:
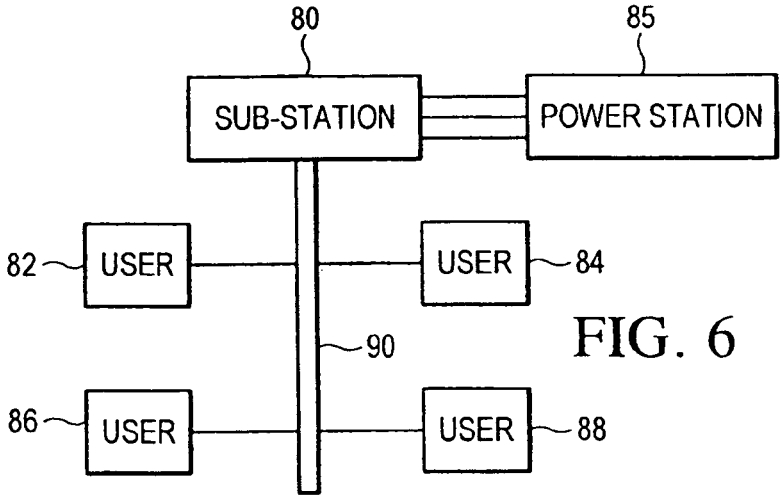
FIG. 6 illustrates an example energy grid connected to a lift system.

FIG. 6 illustrates an example of a simplified energy grid 90 connected to a lift system. The lift system could be either of the users 82, 84, 86 or 88. The users 82-88 are connected to the power grid 90. The power grid 90 may further be connected to a substation 80. The substation 80 may serve to allocate or control a flow of electricity from and between the users 82-88. The substation 80 may further include a means to store electricity. The substation 80 may be local or remote from the users, and may further be connected to or part of a public utility or remote power station 85 by multiple power lines.

A regenerative hydraulic lift system is connected to the power grid 90 as one of the users 82-88, for example user 82. When the hydraulic lift system is acting as a consumer of energy, user 82 draws electricity from the power grid 90. Similarly, other users 84-88 may be acting as consumers of energy and draw additional electricity from the power grid 90. At some point, user 82 may become a generator of electricity, and user 82 may be able to transfer the generated electricity to the power grid 90. The additional electricity generated by user 82 may be transferred to the substation 80 and routed to one or more of the users 84-88 for consumption. Similarly, the electricity generated by user 82 may be placed on the power grid 90 and transferred to remote power stations or power grids for use by other systems or devices, for example, in a public utility. One or more of the users 82-88 could include regenerative hydraulic lift systems, such that electricity generated by any one of them could be distributed or reused between them, thereby increasing the efficiencies of a fleet of lift systems.

The regenerative hydraulic lift system therefore does not require a local external means of storing this energy, but rather it is able to create a voltage supply which is transferred to the main electric power grid that originally powered the lift system. Instead of using a mechanical or pressurized gas to counterbalance the lowering of the down hole components, the regenerative hydraulic lift system uses an electric counterbalanced system. Electricity is generated at a rate that is proportional to the rate that the down hole components are being lowered. In this manner, the energy recovered from lowering the down hole component including the sucker rod 50 is recaptured and transformed into electrical energy fed back into the power grid 90 via the electrical line 527 of the motor 42.

In one embodiment the pump 40 comprises a variable displacement pump. The pump 40 may include a mooring pump or a swallowing pump, or other hydraulic pump. The pump 40 recaptures the operational potential energy of the lift system by providing a controlled rate of resistance. This can be implemented without wasting the operational potential energy as heat that may otherwise occur as a result of throttling the hydraulic fluid, such as in conventional systems which include a throttle. The recapturing of the operational potential energy is transformed into electric energy by spinning the motor 42 faster than its synchronous speed, causing the motor 42 to become a generator which in turn produces clean linear voltage potential/current supply to be fed back onto the power grid 90.

In a further embodiment of the invention, the rod 20 is lowered using the pump 40 to backdrive the electric motor 42. This backdriving action increases the speed of the electric motor 42 from zero, and when an appropriate speed is reached, the power can be reconnected smoothly without any surges. Then, during the remainder of the lowering operation, the electric motor 42 will act as a generator as described above. In this manner the hydraulic system provides inherent soft-starting capabilities.

Figure 7:
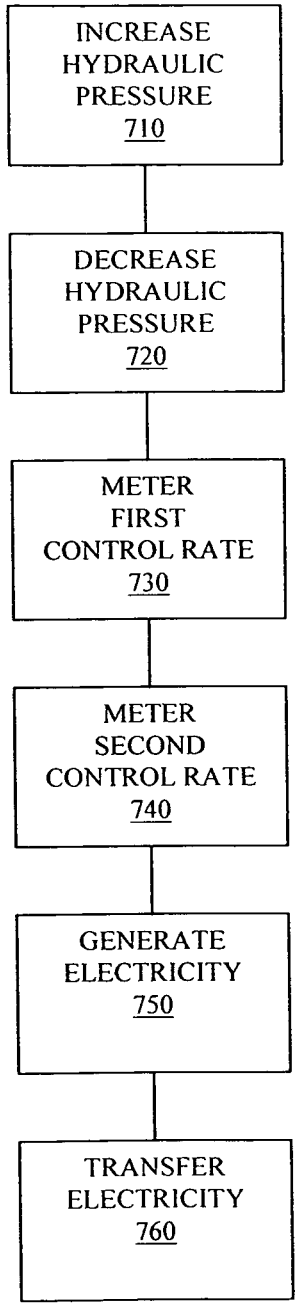
FIG. 7 is a flow chart illustrating an example method of recapturing energy in a lift system.

FIG. 7 is a flow chart illustrating an example method of recapturing energy in a lift system. The lift system may provide a method for pumping a subterranean fluid to the surface of the earth.

In operation 710, a hydraulic pressure within a lift cylinder, such as cylinder 10 of FIG. 3, is increased at a first control rate during a pumping operation, when the rod 20 is being raised. The pumping operation may be performed by the down hole pump 55 shown in FIG. 1.

In operation 720, the hydraulic pressure within the lift cylinder 10 is decreased at a second control rate during a lowering operation, for example a lowering of the down hole pump 55 and a sucker rod 50.

In operation 730, an amount of down hole fluid being pumped is controlled during the pumping operation by metering the first control rate. A pump, such as pump 40 of FIG. 1, may be used to meter the first control rate of the hydraulic pressure.

In operation 740, a lowering speed of a down hole pump 55 is controlled by metering the second control rate. Both the first and second control rates may be metered according to a hydraulic pressure being provided by the pump 40. A sensor, such as sensor 30, may provide input to a controller 514, which is used to control the first and second control rates provided by the pump 40. The sensor input may include a position input. For example, the sensor 30 may measure a relative position of the rod 20 that reciprocates within the hydraulic cylinder 10.

In operation 750, electricity is generated during the lowering operation. The electricity may be generated by spinning the motor 42 faster than a synchronous speed during the lowering operation such that the motor 42 operates as a generator. A rotational torque may act on the motor 42 when hydraulic fluid is swallowed by the pump 40, such that a supply port of the pump 40, such as port 530, operates as an inlet port during the lowering operation.

In operation 760, the electricity is transmitted to a power grid. The power grid may include a local power station or be part of a public utility. The electricity generated by the motor 42 may then be redistributed for use by other devices or systems connected to the power grid.

Having described and illustrated the principles of the invention in a preferred embodiment thereof, it should be apparent that the invention may be modified in arrangement and detail without departing from such principles. I claim all modifications and variation coming within the spirit and scope of the following claims.

The invention claimed is:

1. A method for pumping a subterranean fluid to the surface of the earth comprising:

increasing a hydraulic pressure at a first control rate during a pumping operation;

decreasing the hydraulic pressure at a second control rate during a lowering operation;

controlling an amount of down hole fluid being pumped during the pumping operation by metering the first control rate without throttling at any time during the pumping operation;

controlling a lowering speed of a down hole pump by metering the second control rate without throttling during the lowering operation, the first and second control rates being metered without throttling according to a hydraulic pressure being provided by a pump; and generating electricity during the lowering operation.

2. The method according to claim 1 including transmitting the electricity to a power grid.

3. The method according to claim 1 including spinning a pump motor faster than its synchronous speed during the lowering operation such that the motor operates as an alternating current generator.

4. The method according to claim 3 including generating a rotational torque on the motor when hydraulic fluid is swallowed by the pump, a supply port of the pump operating as an inlet port during the lowering operation.

5. The method according to claim 1 including reciprocating a rod within a cylinder, where the rod is radially spaced apart from a sensor within the cylinder, the sensor measuring a position of the rod.

6. The method according to claim 5 where a longitudinal axis of the rod is offset from a centerline of the cylinder.

7. The method according to claim 6 where the offset rod inhibits a rotation of a piston that slideably interacts with the sensor.

* * * * *